US005149210A

United States Patent [19]

Eriksson

[11] Patent Number: 5,149,210

[45] Date of Patent: Sep. 22, 1992

[54] APPARATUS FOR RECORDING AND/OR READING INFORMATION

[75] Inventor: Björn S. H. Eriksson, Sollentuna, Sweden

[73] Assignee: Digital Equipment Corporation, Maynard, Mass.

[21] Appl. No.: 647,863

[22] Filed: Jan. 30, 1991

[30] Foreign Application Priority Data

Feb. 2, 1990 [SE] Sweden ..... 9000373

[51] Int. Cl.[5] ..... B41J 11/20

[52] U.S. Cl. ..... 400/56; 400/59; 400/57; 400/27

[58] Field of Search ..... 400/55, 1, 60, 56, 57, 400/58, 59, 352, 353, 120, 23, 24, 25, 27; 101/93.03

[56] References Cited

U.S. PATENT DOCUMENTS

| | | | |
|---|---|---|---|
| 3,912,068 | 10/1975 | Kwan | 400/586 X |
| 3,999,749 | 12/1976 | Zambolin | 400/26 |
| 4,029,193 | 6/1977 | Kwan | 400/27 |
| 4,039,069 | 8/1977 | Kwan | 400/27 X |
| 4,844,632 | 7/1989 | Minowa | 400/120 |
| 4,883,375 | 11/1989 | Karube | 400/55 |

FOREIGN PATENT DOCUMENTS

| | | | |
|---|---|---|---|
| 999636 | 11/1976 | Canada | 400/55 |
| 0213934 | 8/1986 | European Pat. Off. . | |
| 0336734 | 4/1989 | European Pat. Off. . | |
| 2318947 | 10/1974 | Fed. Rep. of Germany | 400/26 |
| 82776 | 5/1983 | Japan | 400/24 |
| 179774 | 8/1986 | Japan | 400/55 |
| 211176 | 9/1987 | Japan | 400/55 |

*Primary Examiner*—Edgar S. Burr
*Assistant Examiner*—Eric P. Raciti
*Attorney, Agent, or Firm*—Ronald E. Myrick; Barry N. Young; Ronald C. Hudgens

[57] ABSTRACT

A recording and/or reading head has a recording and/or read nose and is movably mounted. The head is preloaded against a record carrier with first and second preload values. A sensor device senses and maintains the distance between the record carrier and the nose constant. The preloading structure includes a spring loaded cam operated mechanism acting between the head and the record carrier via a spring loaded wheel secured to the head, the wheel engaging the record carrier. A switching mechanism switches the apparatus between the first and second preload conditions. The apparatus can print or operate with documents of different thicknesses.

12 Claims, 2 Drawing Sheets

APPARATUS FOR RECORDING AND/OR READING INFORMATION

FIELD OF THE INVENTION

The present invention relates to an apparatus for recording information on a record carrier and/or reading information from the same, comprising a recording and/or reading head, means for movable supporting of the head in a direction from or towards the record carrier to adjust the recording and/or reading distance, means for preloading against the record carrier and means for maintaining a distance between the record carrier and the front of the head. Apparatus of this kind is particularly suitable for use as printers, but do not exclude another kind of recording and/or reading.

Of interest is commonly owned copending application entitled "Apparatus for Recording and/or Reading Information" by E. C. G. Lindelow Ser. No. 647,905 filed concurrently herewith.

BACKGROUND OF THE INVENTION

An apparatus according to the above for recording and more specifically a matrix printer is previously known from DE "Offenlegungschrift" 2 318 947. In the apparatus a spring is used to preload the head in a direction towards the record carrier. In order to manage printing on different types of documents the apparatus is provided with a pair of distance measuring means. When printing on thick document first distance measuring means in the shape of a wheel is effective, the wheel running along the document under a spring force. When the document is thinner, the first distance means becomes non-effective and the second distance means are then activated which also are in the shape of a wheel. This wheel runs along a guide rail located at a essentially constant distance from the print bed of the document. The head has a given constant distance to the print bed independent of the thickness of the document up to the thickness when the first distance measuring means takes over the distance adjustment of the head. For thin documents it may be observed that the distance of the head to the record carrier varies in accordance with the thickness of the document and that no contact is present between the head and the document.

The prior art apparatus according to the above has some disadvantages. When printing for example in a bank-book, the thickness of the document may vary substantially. In certain cases the printing may take place under conditions applicable for thin documents while printing in other cases takes place under conditions applicable for thick documents. For bank-books, it is desired that all of the printing occurs while maintaining a certain pressure against the document and accordingly this is not fulfilled in the prior art apparatus in the case when printing such sections of the book that comprise thin documents. Furthermore, the apparatus during the printing of the document may pass between a condition for printing of thin documents and a condition for printing of thick documents. Such possible passages may give rise to disturbances in the printing at the passage itself and differences in the printing in the finished document between sections printed under conditions for thin documents and sections printed under conditions for thick documents.

SUMMARY OF THE INVENTION

It is an object of the invention to obtain an apparatus which records on different kind of documents. This is obtained by an apparatus according to an embodiment of the invention wherein the means for preloading comprises first preloading means acting between the head and distance measuring means to obtain a first head preload against the record carrier in a first condition and second preloading means acting between the head and the means for supporting the head to obtain a second preload of the head against the record carrier in a second condition, the second preload being higher than the first.

By means of the apparatus according to the invention a first and a second preload of the head against the record carrier are obtained such that, for example, thin documents and documents with printing copies may be printed under the pressure of the first lower preload to avoid marks on the document, while documents of the bank-book kind of different thicknesses may be printed under the second higher preload giving a better following of the pages of the bank-book.

According to an embodiment of the invention for recording and/or reading at the same distance from the record carrier under two conditions having different preloads, the apparatus includes a switch for switching between a first condition having a first preload of the head towards the record carrier and a second condition having a second preload towards the record carrier, the switch under the second condition delimiting the movement of the distance measuring means and defining a constant distance between the record carrier and the front of the head when the distance measuring means are pressed under the influence of the second preloading means.

In order to switch between the two conditions with different preloads only a simple switch is required. According to another favorable embodiment the switch comprises a slide displaceable in a plane parallel to the record carrier, the surface facing the record carrier comprising at least one higher and one lower section, in the second condition with the second preload the higher section delimiting the movement of the distance measuring means in a direction towards the head to define a constant distance between the record carrier and the front of the head. The higher section of the slide provides a simple delimiting of the movement of the distance measuring means at the same time as the head assumes a suitable constant distance to the record carrier under the second preload.

The slide may be rendered switchable through the movement of the head to a region outside its recording region. An apparatus having such a switching comprises a switch arranged to be switched between the first condition with the first preload and the second condition with the second preload by a movement of the head essentially in parallel with the record carrier to a position outside the recording region of the record carrier, a movement to a position outside one flank of the recording region providing a switching to the first condition, a movement to a position outside the other flank of the recording region providing a switching to the second condition.

In this connection, the switching of the preload of a head against a record carrier per se is known, see EP-A2 213 934 which corresponds to U.S. Pat. No. 4,844,632 incorporated by reference herein. The preload switching of the head is obtained by the fact that the point of action for a spring may be moved between two positions along a level-like element. This element supports a head at one side of the center of rotation of a lever and comprises points of action for the spring at the opposite side of the center of rotation. Under the two preloading conditions, the preload operates between means for supporting the head and the head. There is no correspondence to the distance measuring means according to the present invention disclosed in the aforementioned patent.

For movably supporting the head, the means for movably supporting the head comprises coupling means coupled between the head and a drive motor, the coupling means under the first condition applying the second preload.

The second preload which is applied by the coupling means under the first condition with a first preload prevents recoils that may arise when activating the head, for example, when activating needles in a needle printing head, which recoils adversely influences the head. Another task is to maintain the coupling means in a well-defined position in which the influence of a possible play is prevented. The coupling means according to the above embodiment advantageously comprises a link arm coupled between the head and a curved cam on a drive motor shaft. The coupling means comprises a link arm which in one of its ends is pivotally coupled to the head and in the other end is provided with the cam follower, which under the first condition runs along the cam and which under the second condition is disengaged from the cam. The cooperation between the follower of the link arm and the cam under the first condition keeps the head at an essentially constant distance from the record carrier via the link arm and nullifies the effect of the second preload at the same time as the first preload is free to operate. Information about the constant distance is obtained from a sensor. Under the second condition the link arm is disengaged from the cam and the head is preloaded with the second preload.

According to another favorable embodiment distance measuring means are provided on a pivotal arm. The arm is coupled to a sensor sensing the position of the arm relative to the head. A spring included in the first preloading means operates on the arm. The distance measuring means are provided in one end of and essentially in the center of a pivotally journalled arm, the other end of which is included in a sensor sensing the position of the arm relative to the head, and the first preloading means comprises a spring arranged to operate between the arm and relative to a head fixed point to preload the distance measuring means against the record carrier via the arm.

BRIEF DESCRIPTION OF THE DRAWING

The invention will now be described in more detail with reference to the accompanying drawings.

DESCRIPTION OF THE PREFERRED EMBODIMENT

Figure 1:
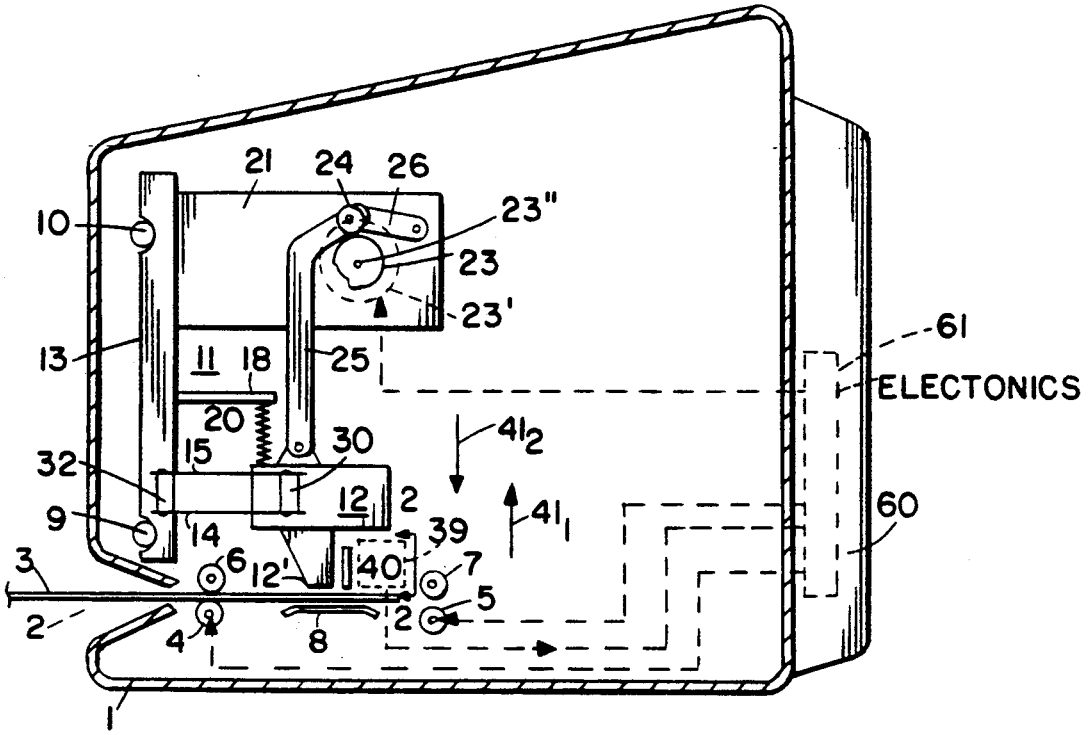
FIG. 1 shows a side sectional elevation view of an apparatus according to an embodiment of the invention.

According to FIG. 1 the apparatus for recording information on a record carrier and/or reading the same is provided with an envelope 1 having an input/output opening 2 for a record carrier 3. The envelope 1 is shown in the figure with one side wall removed. In the rear section of the apparatus there is space 60 for the electronics 61 of the apparatus. For feeding in or feeding out of the record carrier 3, the envelope contains two roller pairs 4, 6 and 5, 7 each having a feed roller 4 and 5, respectively. The fed rollers are driven by electronics 61. A print bar 8 is schematically shown between the front roll pair 4, 6 and the read roller pair 5, 7. Two parallel rods 9, 10 perpendicular to the plane of the drawing support a carriage 11 with a head 12.

The carriage 11 comprises a base plate 13 which is displaceable on the rods 9, 10 to obtain a displacement parallel to the record carrier 3. The record and/or read head 12 is supported by the base plate 13 by two pairs of leaf springs, one pair 14 and 15 being visible in FIG. 1. The head 12 has a nose 12'. The leaf springs are attached in projecting sections 30 of the head 12, one section 30 being visible in FIG. 1, and projecting sections 32 on the base plate 13, one section 32 being visible in FIG. 1. A stiff arm 18 upstands cantilevered from the base plate 13. A spring 20 is attached between the cantilevered end of the stiff arm 18 and the head 12. The spring 20 acts as a compression spring between the arm and the head and gives the head a preload bias force in a direction towards the record carrier 3 and the print bar 8. Adjacent to the nose 12' of the head 12 is distance measuring means comprising a wheel 40 and assembly 39. Assembly 39 includes a sensor arrangement described below coupled to electronics 61 for operating the sytem in a manner to be described. The coupling of the wheel 40 to the head 12 is not shown in more detail here, but will be shown and explained with reference to FIGS. 2 and 3. A plate 21 is secured perpendicular to the base plate 13. A drive motor 23', preferably a step motor, may be fixed to plate 21. The drive motor 23' is coupled to the head 12 through a curved cam 23 secured to the drive motor drive shaft 23'', the cam cooperating with a cam follower wheel 24 on one end of link arm 25, the other end of arm 25 being pivotally attached to the head 12. The drive motor is driven under control of electronics 61. A link arm 26 is pivotally journalled in the plate 21 in one end of the arm and in the center of the wheel 24 in the other arm end. Arm 26 keeps the link arm and the wheel 24 in position for cooperation between the wheel 24 and the cam 23.

Figure 3:
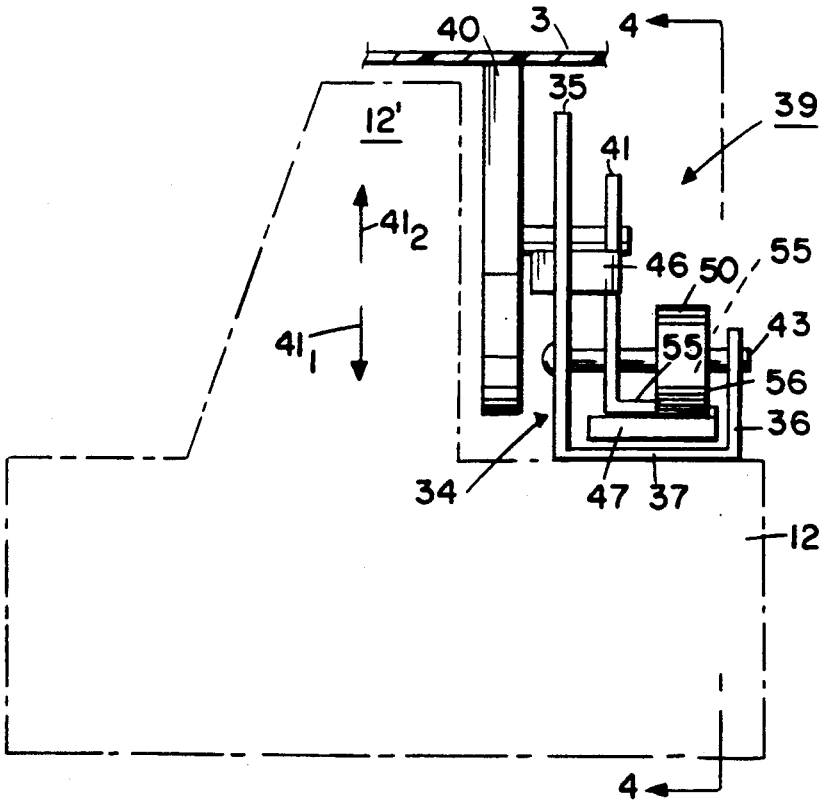
FIG. 3 shows a side elevation view taken along lines 3—3 of FIG. 2 of the coupling of the distance measuring means to the head.
Figure 2:
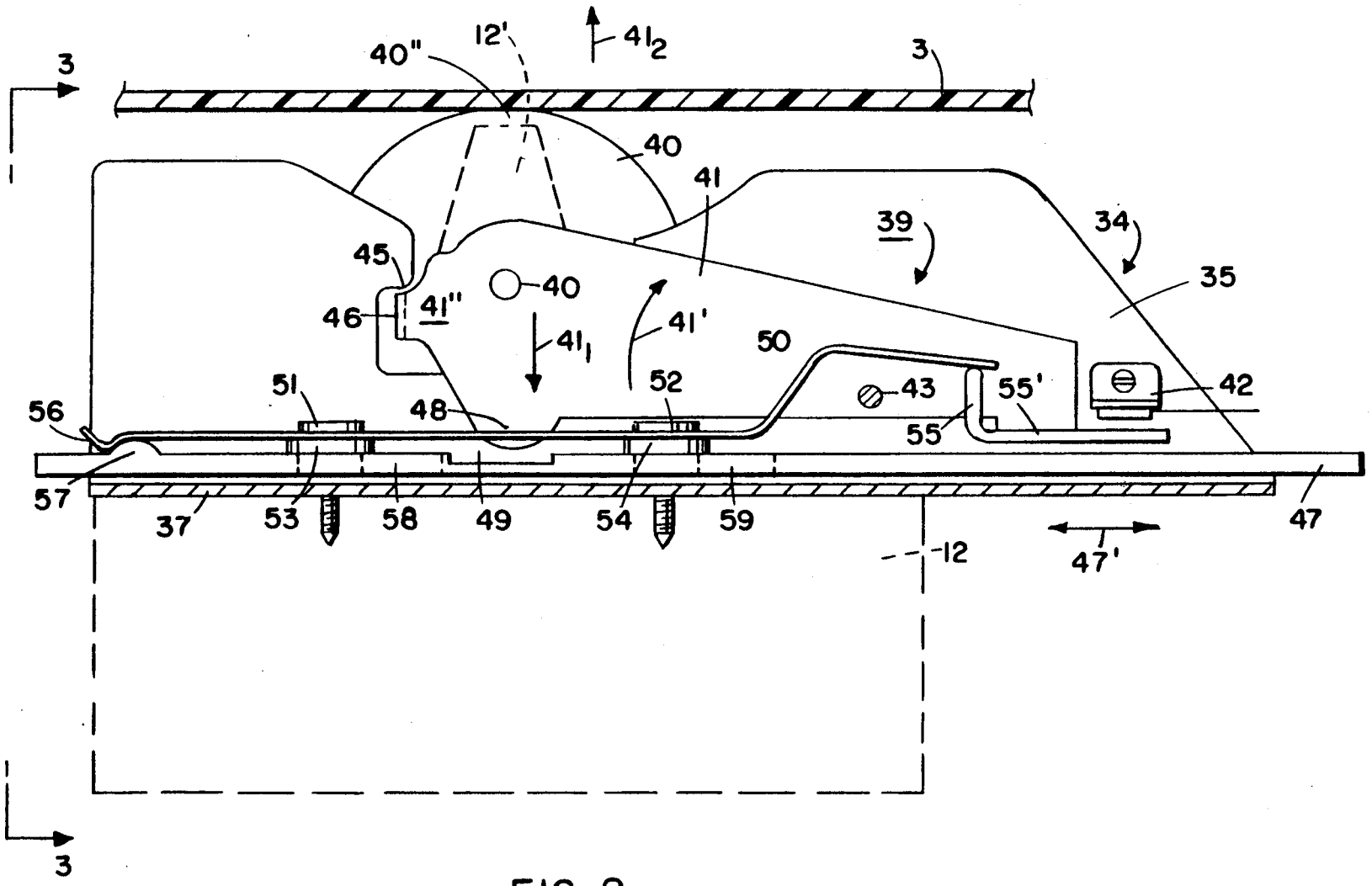
FIG. 2 is taken along lines 2—2 of FIG. 1 and lines 4—4, FIG. 3 and shows the coupling of the distance measuring means to the head.

FIGS. 2 and 3, which are oriented 180° from that of FIG. 1, in more detail show the coupling of the distance measuring wheel 40 to the head 12, the head 12 being indicated by broken lines. The distance measuring means wheel 40, which measures the distance of head 12 to record 3 via assembly 39 and preloads head 12 with a force via spring loads on wheel 40, is rotatably journalled on shaft 40' in one end of rotatable arm 41. The other end of the arm 41 is coupled to a sensor 42 of assembly 39 for registration of the head 12 nose 12' distance to the record carrier 3 via wheel 40. At a position between the two ends of the arm 41 and preferably in the vicinity of the arm 41 center, the arm 41 is rotatably journalled to a shaft 43. The shaft 43 is fixed to a support 34, which by means of screws 51, 52 is secured to the head 12. The support 34 comprises two walls in parallel 35, 36 and a bottom section 37 in between (FIG. 3) forming a channel member. In FIG. 2, one of the parallel walls 36 is not shown because this view is taken along lines 4—4, FIG. 3. The shaft 43 is supported by the two parallel walls 35 and 36.

The rotary movement of the arm 41 towards the record carrier 3 in direction 41' is restricted by lip 45 on the support wall 35. The lip 45 cooperates with a projecting tongue 46 attached to in the head end 41" of the arm 41. The movement of the arm 41 about shaft 43 is restricted in a direction $41_1$ from the record carrier 3 by a displaceable slide 47 cooperating with a projecting section 48 of the arm 41. Due to the fact that the slide 47 is displaceable between two positions, directions 47', the slide 47 has different thicknesses adjacent to the projecting section 48 of the arm 41 in accordance with the position of slide 47 in directions 47', and thereby the movement of the arm 41 away from the record carrier in direction $41_1$ may be restricted more or less. With a slide 47 recess 49 that is formed by a reduced thickness in the slide aligned with the projecting section 48 of the arm 41 in direction $41_1$, a greater freedom in movement of the arm 41 is obtained than without the recess 49. A leaf spring 50, fixed to the head 12 by screws 51 and 52 and spacer elements 53 and 54, preloads the arm 41 with a bias force in a direction 41' towards the record carrier 3 by one spring end engaging head 55 formed in the sensor end of the arm 41. Head 55 is attached to arm 41 via leg 55'. The other end of the spring 50 is provided with a bent section 56 for detent cooperation with a projection 57 on the slide 47. The slide 47 has oblong openings 58 and 59 restricting the displacement of the slide 47. In FIG. 2, the slide 47 is in its right most position in which further movement to the right is prevented by means of the left ends of the oblong openings abutting on the respective left sides of the spacer elements 53, 54. The projection 57 in cooperation with the bent section 56 acts as a detent and keeps the slide fixed in the shown right most position. In the left most position of the slide 47, the movement of the slide is restricted to the left in a corresponding way as for the right position by cooperation between the spacer elements 53 and 54 and the right most sides of the openings 58 and 59. Cooperation between the projection 57 and the bent section 56 releasably holds the slide fixed in its left most position. The slide 47 is switched from the shown right position, FIG. 2, to the left position by moving the head 12 to the right to a position outside the recording region of the head 12 and in which the left end of the slide hits a stop, not shown. The stop may consist of a rotatable end plate (not shown) carrying one end of two parallel rods 9, 10 on which the carriage 11 is displaceable, FIG. 1. The switching from the left position of the slide 47 to the right position takes place in a corresponding way by moving the head to the left to a position outside the recording region of the head within which the head hits a stop (not shown) displacing the slide to the right position. Before the head 12 is transported outside the recording region of the head 12 to the left or the right, the head 12 is displaced backwards direction $41_1$ away from record 3 by the drive motor driven cam 23. The arm 41 will thereby rest on the lip 45 through the tongue 46 under the influence of the spring 50 (direction 41') when the slide is switched. This prevents unnecessary wear at the recess 49 of the slide 47.

Below two operating modes having different preloads will be described.

First the case is described when recording takes place under a relatively high preload bias force pressure and which is suitable, for example, for recording in bank books. Before the recording can start, it is ensured that the slide 47 is in its left position. This is obtained by transporting the head to the right to a region outside its recording region as described in the preceding paragraph. Then the head is moved towards the record carrier, direction $41_2$, by means of the pressure spring 20, FIG. 1, in the degree determined by the cam 23 to which the head is coupled via the link arm 25. When the distance measuring wheel 40 comes into contact with the record carrier 3, the arm 41 is rotated around the shaft 43, opposite direction 41', towards and in contact with the slide 47 by means of the projecting section 48 of the arm. The head 12 is now preloaded with a bias force via wheel 40 against the record carrier 3 under the influence of the pressure spring 20. The cam 23 is further rotated to obtain a play between the cam 23 and the wheel 24. The head and nose 12' is now in condition to start recording under the higher preload. The force that the pressure spring 20 exercises is of the order of magnitude 6–8N. The slide 47 ensures that the head nose 12' is maintained a suitable constant distance from the record carrier 3.

To record under lower preload bias force the slide is switched to the right position shown in the figure with the recess 49 in the slide just opposite the projecting section 48 of the arm 41. Printing under a lower preload force is suitable in thin documents and printing copies. The switching may be carried out according to the description above. The head nose 12' is held at a distance from the record carrier 3 by using the distance information sensed from the sensor 42 by means of the cam 23 which via the wheel 24 and the link arm 25 determines the head position. The cam 23 is driven by a motor 23' controlled by the distance information from the sensor 42. The distance to which the cam is set is such that the arm 41 is in a position in which it neither engages the lip 45 on the support 34 or the recess 49 of the slide 47. The head 12 via wheel 40 is preloaded against the record carrier 3 under the influence of the spring 50. The spring force in the forward direction $41_2$ may amount to approximately 1.5N. A suitable distance between the head noise 12' and the record carrier may be 0.35–0.4 mm when printing is connected. Before the arm 41 is loaded, the front section 40" of the wheel 40 may be situated for example 1 mm in front of the head front at nose 12'. Accordingly, when recording under a lower preload bias force, the preload bias force is obtained from the spring 50. The distance of the head 12 noise 12' from the record carrier 3 is adjusted starting from the distance information from the sensor coupled to the arm 41 and the support. The wheel 24 on the link arm 25 rests on the cam 23 under normal circumstances, but may be disengaged in response to an obstacle at the front of the head at nose 12' while overcoming the force of the pressure sping 20.

The information about the distance between the head 12 nose 12' and the record carrier 3 as measured by the sensor 42 may be used in a servo control of the cam 23. When the measured distance information from the sensor 42 deviates from a desired value the cam 23 is rotated to eliminate the deviation.

Another way to adjust the distance of the head 12 from the record carrier 3 is the following. The head 12 is moved towards the print bar 8 until a predetermined distance from the print bar is reached, which is sensed by the sensor 42 and commonly is the desired distance between the head 12 nose 12' and the record carrier 3 when printing. The head 12 is then moved along the print bar 8 without movement of the head perpendicular to the print bar 8 at the same time as the measured distance information from the sensor is memorized. This means that the print bar shape is read and memorized. When a record carrier 3 is inserted the head is again moved to a position with the same predetermined distance but now from the record carrier. The difference between the distance at a chosen point without and with a record carrier in front of the print bar 8 is calculated. When reading and/or recording, the distance between the head 12 and the record carrier 3 is adjusted according to the memorized measured distance information corrected with the calculated distance difference for the point chosen.

Even if the spring 50 alone has the responsibility for the preload bias force in the shown right position for the slide 47, the spring 20 has substantial tasks. The spring 20 must prevent recoils from occuring when the printing needles of the head are activated causing a disturbing influence on the head. Furthermore the spring 20 keeps the link arm 25 under a well defined tension so that possible plays in the bearing of the link arm do not cause a disturbing influence on the positioning of the head.

The apparatus as described is provided with a switch which makes it possible to record and/or read at the same distance between the head and the record carrier both under a higher and lower preload. It is however possible to leave out the switch if it is ensured that recording and/or reading are (is) provided at a greater distance between the head and record carrier under the lower preload than under the higher preload. The distance is detected by the sensor 42 and is adjusted by means of the drive motor coupled to the head via the cam 23 and the link arm 25.

I claim:

1. Apparatus for recording and/or reading information on a record carrier comprising:

a head having a recording and/or reading nose;

means for receiving a recording medium;

means for movably supporting the head; and means in contact with said received medium during operation of said apparatus for maintaining a spaced apart distance between the received medium and said nose;

first preload means for applying a first preload bias force to said means for maintaining a spaced apart distance between the received medium and said nose to establish a first preload condition against the received medium; and second preload means for applying a second preload bias force to said means for maintaining a spaced apart distance between the received medium and said nose to establish a second preload condition against the received medium, the second preload bias force being greater than the first preload bias force.

2. An apparatus as claimed in claim 1 wherein said preloading means includes distance measuring means for measuring the distance between said head and received medium, the distance measuring means being coupled to one end of a pivotally journalled arm, the other end of which comprises sensor means for sensing the pivoted position of the arm relative to the head, said first preloading means comprising a spring operating between the arm and relative to a head fixed point to preload with said first bias force the distance measuring means against the received recording medium via the arm.

3. The apparatus of claim 1 wherein the means for movably supporting the head comprises a drive motor having a drive shaft and coupling means coupled between the head and the drive motor, the coupling means under the second condition coupling the second preload bias force to said head.

4. An apparatus as claimed in claim 3, wherein the coupling means comprises a cam and a cam follower and a link arm having opposing ends and which in one of its ends is pivotally coupled to the head and in the other end is provided with said cam follower which under the first condition engages said cam secured to the shaft of the drive motor and under its second condition is disengaged from the cam.

5. An apparatus as claimed in claim 4 wherein said preloading means includes distance measuring means including sensor means for measuring the distance between said head and received medium, a pivotally journalled arm having opposing ends, the distance measuring means being coupled to one end of said pivotally journalled arm, the other end of which is coupled to said sensor means for sensing the pivoted position of the arm relative to the head, said first preloading means comprising a spring operating between the arm and relative to a head fixed point to preload with said first bias force the distance measuring means against the received recording medium via the arm.

6. The apparatus of claim 1 further comprising switch means for limiting the minimum spaced apart distance established by the means for maintaining such spaced apart distance.

7. The apparatus of claim 6 wherein the switch means comprises a slide displaceable in a plane parallel to the received recording medium, the slide having a surface facing the received record carrier and comprising a stepped portion having at least one higher and one lower section relative to said head.

8. An apparatus as claimed in claim 7 wherein the switch means is arranged to be switched between the first condition with the first preload bias force and the second condition with the second preload bias force in response to movement of the head essentially in parallel with the received record carrier to a position outside the recording region of the received record carrier, a movement to a position outside one side of the recording region providing a switching to the first condition, a movement to a position outside a second side of the recording region providing a switching to the second condition.

9. An apparatus as claimed in claim 6 including means wherein the switch means is switched between the first condition with the first preload bias force value and the second condition with the second preload bias force value by movement of the head essentially in parallel with the received record carrier to a position outside the recording region of the received record carrier, a movement of the head to a position outside one side of the recording region providing a switching to the first condition, a movement of the head to a position outside a second side of the recording region providing a switching to the second condition.

10. An apparatus as claimed in claim 9 wherein the means for moveably supporting the head comprises a drive motor having a drive shaft and coupling means coupled between the head and the drive motor for forming under the first condition the first preload bias force value.

11. An apparatus as claimed in claim 10 wherein the coupling means comprises a cam and a cam follower and a link arm which in one of its ends is pivotally coupled to the head and in the other end is provided with said cam follower which under the first condition engages said cam secured to the shaft of the drive motor and under its second condition is disengaged from the cam.

12. An apparatus as claimed in claim 11 wherein said preloading means includes distance measuring means for measuring the distance between said head and received medium, the distance measuring means being coupled to one end of a pivotally journalled arm, the other end of which comprises sensor means for sensing the pivoted position of the arm relative to the head, said first preloading means comprising a spring operating between the arm and relative to a head fixed point to preload with said first bias force the distance measuring means against the received recording medium via the arm.

* * * * *